US008529181B1

(12) United States Patent
Young

(10) Patent No.: US 8,529,181 B1
(45) Date of Patent: Sep. 10, 2013

(54) WALLBOARD SUPPORT SYSTEM

(75) Inventor: Larry P. Young, Grand Forks, ND (US)

(73) Assignee: Telpro, Inc., Grand Forks, ND (US)

( * ) Notice: Subject to any disclaimer, the term of this patent is extended or adjusted under 35 U.S.C. 154(b) by 418 days.

(21) Appl. No.: 12/951,430

(22) Filed: Nov. 22, 2010

(51) Int. Cl.
*E04F 21/18* (2006.01)

(52) U.S. Cl.
USPC ..... 414/11; 403/109.1

(58) Field of Classification Search
USPC ..... 211/7; 212/302, 303; 248/276.1, 248/354.1; 269/149, 152, 84, 85, 904, 905; 384/53; 403/109.1, 63; 414/10–12, 684.3, 414/785
See application file for complete search history.

(56) References Cited

U.S. PATENT DOCUMENTS 2,677,580 A * 5/1954 Minzenmayer ..... 414/592
2,859,070 A * 11/1958 Gomersall ..... 384/19
3,062,592 A * 11/1962 Allen ..... 384/34
3,467,261 A * 9/1969 Jewell ..... 414/11
3,828,942 A * 8/1974 Young ..... 414/11
4,872,734 A * 10/1989 Rechberg ..... 312/333
4,950,123 A * 8/1990 Brockhaus ..... 414/522
6,007,248 A * 12/1999 Fulterer ..... 384/53
7,448,606 B1 * 11/2008 Johnson ..... 269/17

FOREIGN PATENT DOCUMENTS

EP 777021 A1 * 6/1997

* cited by examiner

*Primary Examiner* — Gregory Adams
(74) *Attorney, Agent, or Firm* — Michael S. Neustel

(57) ABSTRACT

A wallboard support system for effectively supporting a wallboard such as drywall. The wallboard support system generally includes a support base, a telescoping unit extending from the support base and a cradle attached to an upper portion of the telescoping unit to support a wallboard. The cradle is comprised of a support unit having a pair of channels that receive a corresponding pair of outriggers that slidably extend from opposing ends of the support unit. A first guide within a first channel of the support unit guides a first outrigger outwardly and slightly upwardly. A second guide within a second channel of the support unit guides a second outrigger outwardly and slightly upwardly mirroring the first outrigger.

20 Claims, 6 Drawing Sheets

WALLBOARD SUPPORT SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to wallboard lifts and more specifically it relates to a wallboard support system for effectively supporting a wallboard such as but not limited to drywall.

2. Description of the Related Art

Any discussion of the related art throughout the specification should in no way be considered as an admission that such related art is widely known or forms part of common general knowledge in the field.

Conventional wallboard lifts have been in use for years. Conventional wallboard lifts are comprised of a support unit with a pair of opposing outriggers that are slidably received by channels within the support unit. The opposing outriggers are extended outwardly when they are to support a wallboard such as but not limited to drywall.

One problem with conventional wallboard lifts is that there is limited space between the outriggers and the channels within the support unit thereby creating undue friction from rust and dirt. In addition, any damage to the support unit (e.g. dent, bending, etc.) can make it difficult to retract or extend the outriggers from the support unit. Finally, conventional wallboard lifts have a significant surface contact area between the outriggers and the support unit thereby increasing the resistance when extending or retracting the outriggers.

Because of the inherent problems with the related art, there is a need for a new and improved wallboard support system for effectively supporting a wallboard such as drywall.

BRIEF SUMMARY OF THE INVENTION

A system for effectively supporting a wallboard such as drywall. The invention generally relates to a drywall lifts which includes a support base, a telescoping unit extending from the support base and a cradle attached to an upper portion of the telescoping unit to support a wallboard. The cradle is comprised of a support unit having a pair of channels that receive a corresponding pair of outriggers that slidably extend from opposing ends of the support unit. A first guide within a first channel of the support unit guides a first outrigger outwardly and slightly upwardly. A second guide within a second channel of the support unit guides a second outrigger outwardly and slightly upwardly mirroring the first outrigger.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
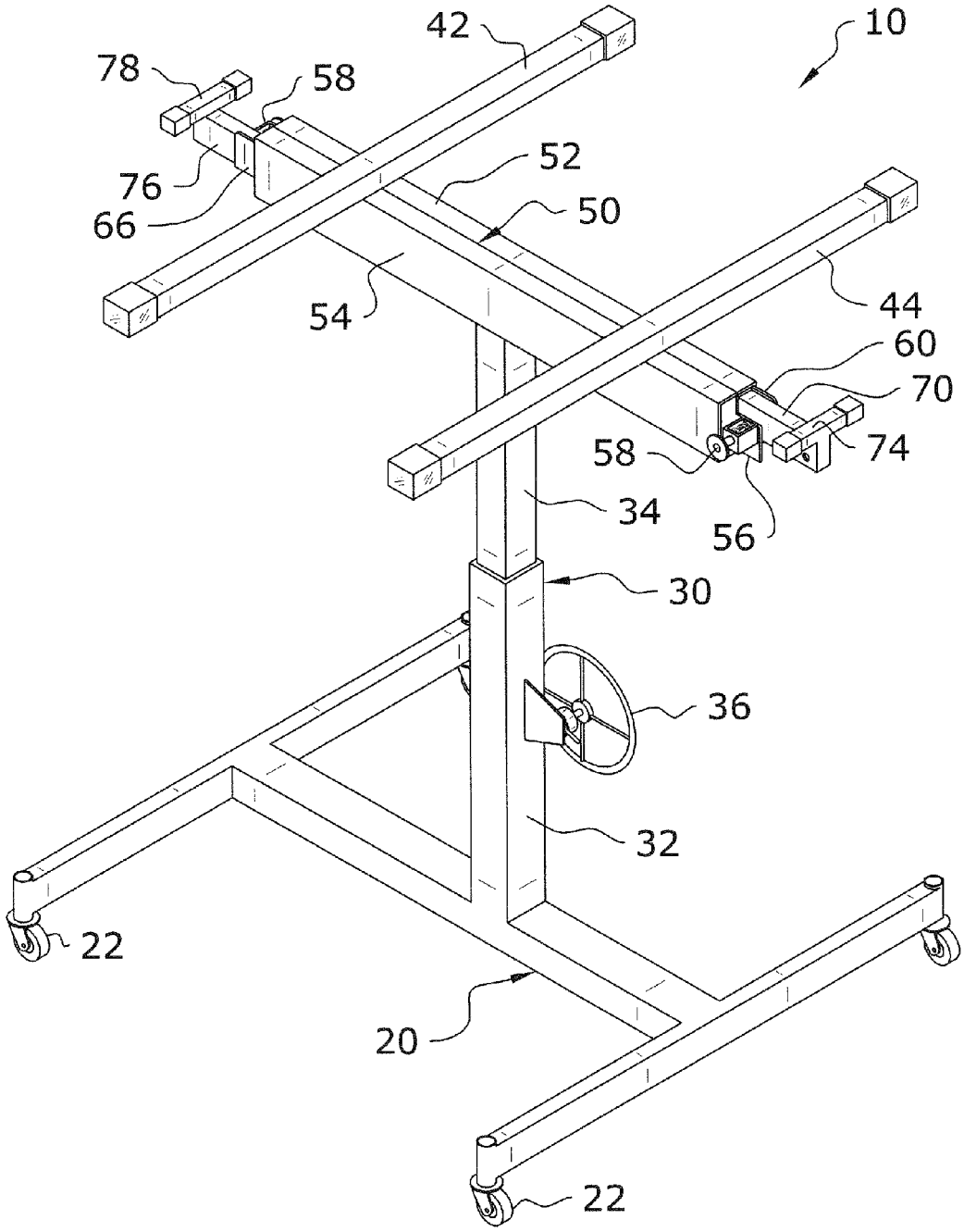
FIG. 1 is an upper perspective view of the present invention.

Turning now descriptively to the drawings, in which similar reference characters denote similar elements throughout the several views, FIGS. 1 through 6 illustrate a wallboard support system 10, which comprises a support base 20, a telescoping unit 30 extending from the support base 20 and a cradle 40 attached to an upper portion 34 of the telescoping unit 30 to support a wallboard 12. The cradle 40 is comprised of a support unit 50 having a pair of channels that receive a corresponding pair of outriggers 70, 76 that slidably extend from opposing ends of the support unit 50. A first guide 60 within a first channel 51 of the support unit 50 guides a first outrigger 70 outwardly and slightly upwardly. A second guide 66 within a second channel 53 of the support unit 50 guides a second outrigger 76 outwardly and slightly upwardly mirroring the first outrigger 70.

B. Support Base

Figure 6:
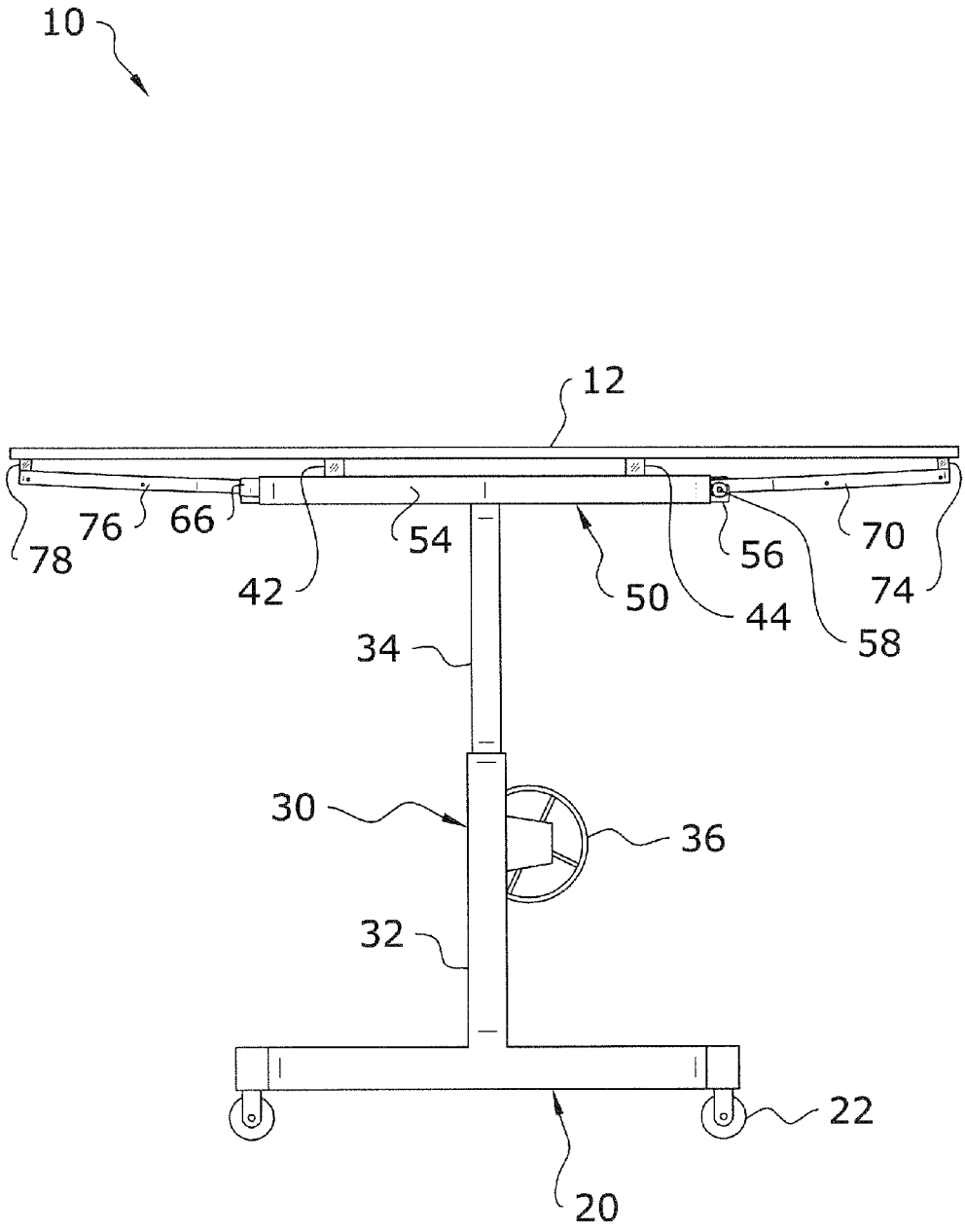
FIG. 6 is a side view of the present invention with the outriggers fully extended and supporting a wallboard.

FIGS. 1 and 6 of the drawings illustrate an exemplary support base 20 that provides support to the present invention during operation. The support base 20 preferably has a relatively broad cross section to increase the stability of the present invention during use. Various configurations may be utilized for the support base 20 including but not limited to an I-shaped base as illustrated in FIG. 1. To provide increased mobility for the present invention, one or more wheels 22 are preferably connected to the support base 20 to allow for rolling of the present invention on a floor surface.

C. Telescoping Unit

The telescoping unit 30 provided with the present invention may be comprised of any type of structure that extends upwardly and downwardly to support the cradle 40 along with a wallboard 12. The telescoping unit 30 extends upwardly from the support base 20 as illustrated in FIGS. 1 and 6 of the drawings.

The telescoping unit 30 is preferably comprised of a lower portion 32 attached to the support base 20 and an upper portion 34 that movably extends from the lower portion 32 by a lifting/lowering mechanism 36. The lifting/lowering mechanism 36 may be comprised of a manual or powered system to cause the upper portion 34 to lift and lower with respect to the lower portion 32. The upper portion 34 of the telescoping unit 30 is preferably concentric with respect to the lower portion 32 and is preferably vertically orientated.

D. Cradle

The cradle 40 is attached to an upper portion 34 of the telescoping unit 30 as illustrated in FIGS. 1 and 6 of the drawings. The cradle 40 is formed to support a conventional wallboard 12 (e.g. sheetrock, plywood, paneling, etc.).

The cradle 40 is preferably comprised of a support unit 50, a first outrigger 70 slidably extending from a first end of the support unit 50 and a second outrigger 76 slidably extending from a second end of the support unit 50. The outriggers 70, 76 are comprised of elongated structures that support the opposing distal portions of the wallboard 12 when positioned on the cradle 40. The first outrigger 70 and the second outrigger 76 substantially mirror one another when fully extended from the support unit 50 and when both are retracted into the support unit 50.

Figure 4A:
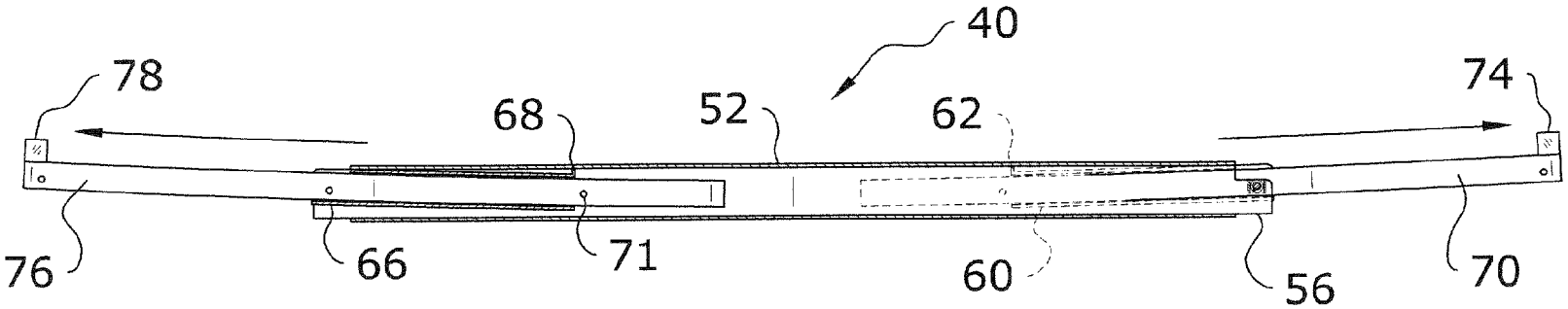
FIG. 4*a* is a side cutaway view of the cradle with the outriggers partially extended from the support unit.
Figure 4B:
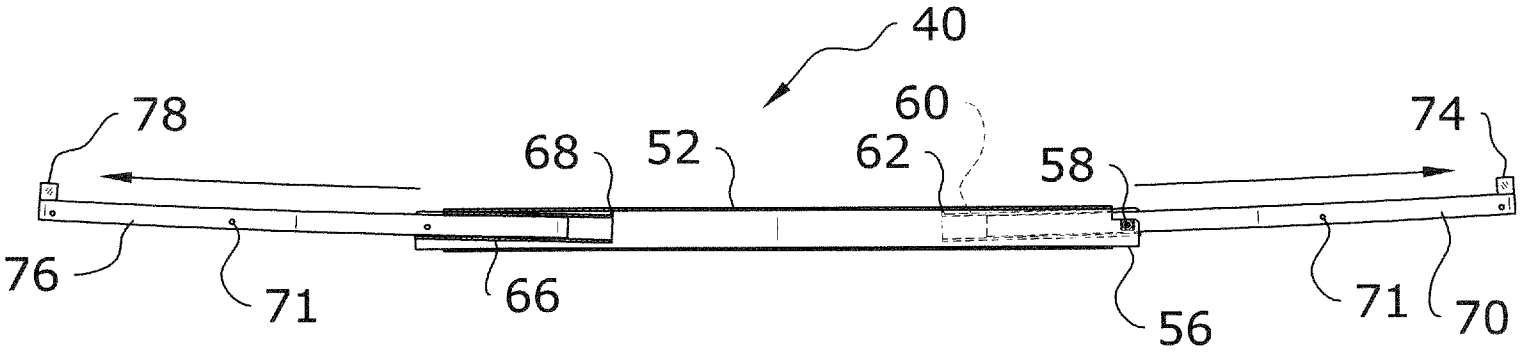
FIG. 4*b* is a side cutaway view of the cradle with the outriggers fully extended from the support unit.
Figure 4C:
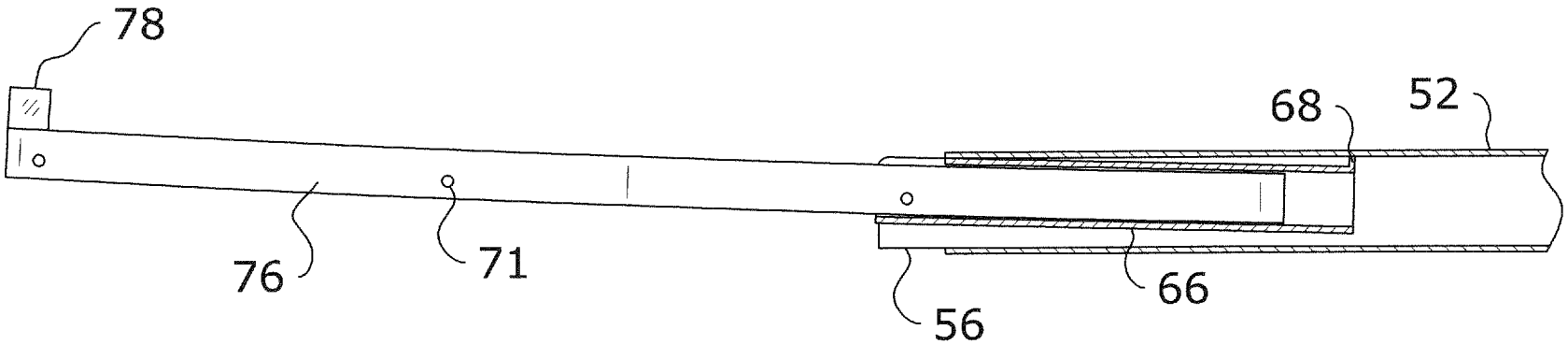
FIG. 4*c* is a magnified side cutaway view of the cradle with the outriggers fully extended from the support unit illustrating the second guide.
Figure 5:
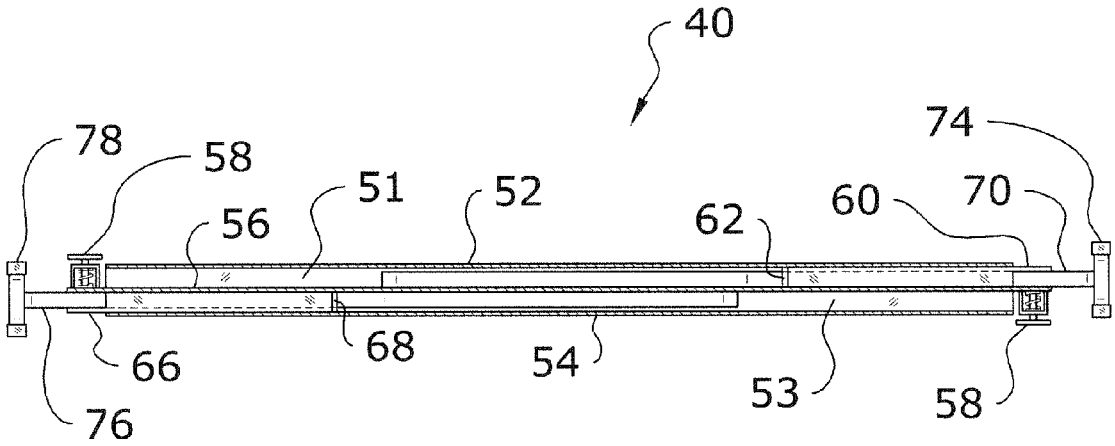
FIG. 5 is a top cutaway view of the cradle with the outriggers retracted within the support unit.

The support unit 50 is comprised of an elongated structure as illustrated in FIGS. 1 through 6 of the drawings. The support unit 50 is preferably comprised of a straight structure as illustrated in FIGS. 1 through 6 of the drawings. The support unit 50 is comprised of a tubular structure that slidably receives the outriggers 70, 76 that extend outwardly from the opposing open ends of the support unit 50. The support unit 50 is preferably comprised of a rectangular cross section tubular structure, however, various other types of structures may be alternatively used. A divider 56 extending along a substantially central portion of the support unit 50 to form a first channel 51 and a second channel 53 that slidably receive the outriggers 70, 76 respectively. The first channel 51 is preferably substantially parallel with respect to the second channel 53 as best illustrated in FIG. 5 of the drawings.

Figure 2:
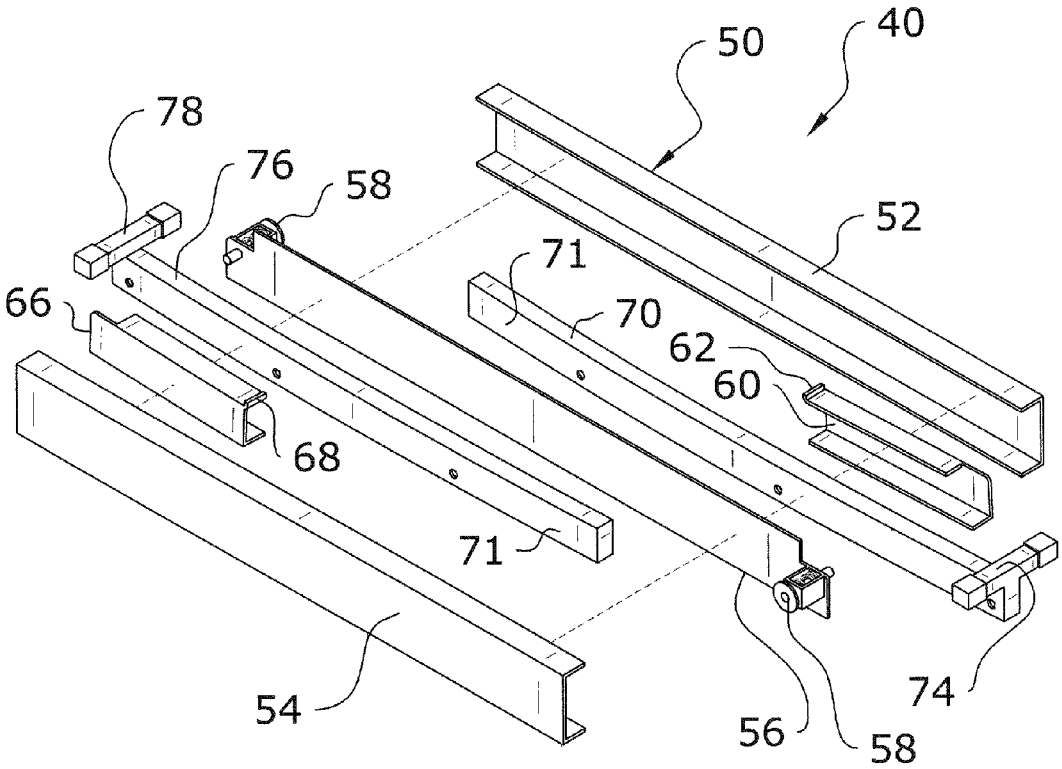
FIG. 2 is an exploded upper perspective view of the cradle support.

The support unit 50 is preferably comprised of a first side 52 having a U-shaped cross sectional shape and a second side 54 having a U-shaped cross sectional shape as illustrated in FIG. 2 of the drawings. The divider 56 is preferably positioned between the first side 52 and the second side 54 as further illustrated in FIG. 2 of the drawings.

The divider 56 is preferably welded between the first side 52 and the second side 54 forming a tubular structure with the first channel 51 and the second channel 53 on opposing sides of the divider 56. The divider 56 preferably includes an extended portion on both distal ends that a latch 58 is respectively attached to for selectively locking the outriggers 70, 76 in a desired location (e.g. retracted, partially extended, fully extended).

Figure 3:
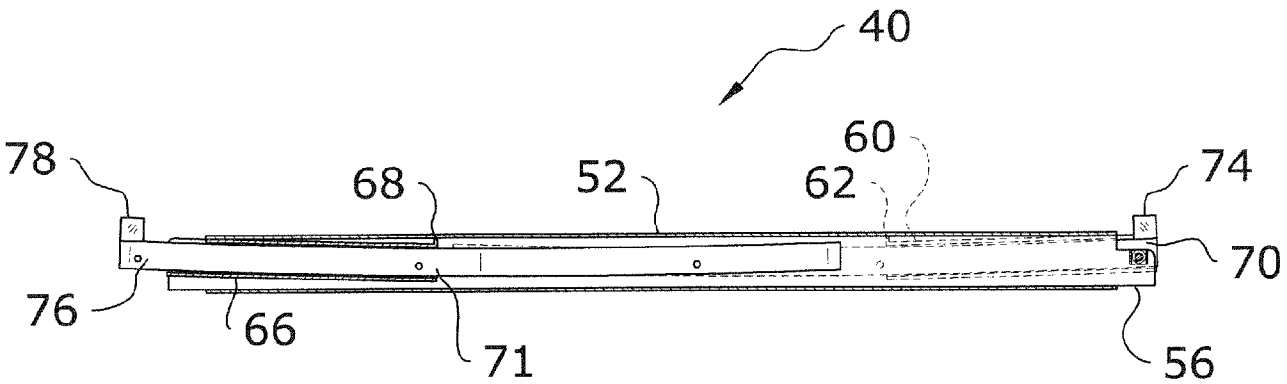
FIG. 3 is a side cutaway view of the cradle with the outriggers retracted within the support unit.

As shown in FIGS. 3, 4*a* and 4*b* of the drawings, a first guide 60 is attached within the first channel 51 of the support unit 50 near the first end of the support unit 50. As shown in FIGS. 3, 4*a* and 4*b* of the drawings, a second guide 66 is attached within the second channel 53 of the support unit 50 near the second end of the support unit 50 opposite of the first guide 60. The first outrigger 70 slidably extends within the first guide 60 and the first channel 51, and the second outrigger 76 slidably extends within the second guide 66 and the second channel 53 as best illustrated in FIGS. 4*a* through 4*c* of the drawings.

As best illustrated in FIGS. 3 through 4*c* of the drawings, the first guide 60 and the second guide 66 are angled upwardly to assist in guiding the outriggers 70, 76 outwardly and upwardly from the respective opposing open ends of the support end. The first guide 60 directs the first outrigger 70 to extend outwardly and upwardly and the second guide 66 directs the second outrigger 76 to extend outwardly and upwardly as illustrated in FIGS. 4*a* through 4*c* of the drawings. The upward guidance of the outriggers 70, 76 ensures that the distal ends of the outriggers 70, 76 are elevated above the body of the support unit 50 to ensure that the wallboard 12 remains substantially flat for installation on a ceiling or other structure.

The first guide 60 and the second guide 66 preferably include a first lip 62 and a second lip 68 respectively extending upwardly from a respective upper inner portion that provides a desired angular alignment for the first guide 60 and the second guide 66. During fabrication of the support unit 50, the guides 60, 68 are preferably aligned with respect to an upper ceiling of their respective side 52, 54 by positioning the respective lip 62, 68 adjacent to the same along with the outer body portion of the guides 60, 68 positioned adjacent the upper ceiling of the respective side 52, 54 as best illustrated in FIGS. 4*a* through 4*c* of the drawings. The guides 60, 68 may be attached to the respective sides 52, 54 via various conventional attachment methods including but not limited to welding and fasteners.

As illustrated in FIG. 2 through the first outrigger 70 and the second outrigger 76 are upwardly curved to assist with ensuring that the distal ends of the outriggers 70, 76 when extended are at a desirable height to support the distal portions of the wallboard 12. The outriggers 70, 76 preferably have a consistent curvature through the entire length of the outriggers 70, 76, however, varying curvatures may be utilized. The combination of the curvature of the outriggers 70, 76 and the upward angle of the guides 60, 68 ensures that the distal ends of the outriggers 70, 76 are properly positioned when fully extended and that the inner ends of the outriggers 70, 76 are not engaging the inner surface of the support unit 50 as illustrated in FIGS. 3 through 4*c* of the drawings. The reduced surface contact between the outriggers 70, 76 and the support unit 50 decreases the frictional engagement of the same and ensures that any damage to the support unit 50 does not interfere with the operation of the outriggers 70, 76 by providing a space between the same.

As shown in FIGS. 1 and 6 of the drawings, the first outrigger 70 preferably includes a first support 74 extending upwardly from a distal portion thereof and the second outrigger 76 includes a second support 78 extending upwardly from a distal portion thereof. The first support 74 and the second support 78 are formed to engage a lower surface of a wallboard 12 to be supported upon the cradle 40 as illustrated in FIG. 6 of the drawings. The first support 74 and the second support 78 preferably include a covering comprised of a resilient material such as rubber or the like to frictionally engage the wallboard 12.

A first latch 58 is preferably attached to the support unit 50 and selectively engages the first outrigger 70 to secure the first outrigger 70 in an extended position or retracted position. A second latch 58 is also preferably attached to the support unit 50 and selectively engages the second outrigger 76 to secure the second outrigger 76 in an extended position or retracted position. The latches 58 58 preferably engage locking apertures 71 within the outriggers 70, 76 to secure the outriggers 70, 76 in a desired extended position as shown in FIGS. 3 through 4*c* of the drawings. The latches 58 58 are preferably spring loaded as best illustrated in FIG. 5 of the drawings.

The preferably cradle 40 includes a first cross member 42 and a second cross member 44 that extend substantially transverse with respect to the first outrigger 70 and the second outrigger 76 as best illustrated in FIG. 1 of the drawings. The first cross member 42 and the second cross member 44 are preferably substantially parallel with respect to one another and include a resilient covering at their respective ends to assist in frictionally engaging the bottom of the wallboard 12 being supported upon the same. The cross members 42, 44 support a middle portion of the wallboard 12 as illustrated in FIG. 6 of the drawings.

E. Operation of Preferred Embodiment

In use, the user lowers the cradle 40 by adjusting the lifting/lowering mechanism 36 to a level where they can position the wallboard 12 on the cradle 40. The user further pulls the outriggers 70, 76 out from the support unit 50 to a fully extended position as illustrated in FIG. 6 of the drawings. A wallboard 12 is positioned on the cradle 40 with the distal portions thereof supported by the outriggers 70, 76. The user then lifts the cradle 40 to a desired elevation near where the wallboard 12 will be secured to (e.g. a ceiling). The wallboard 12 is then secured to the ceiling and the cradle 40 is lowered to position a second wallboard 12 upon the same to repeat the process. When the user is finished using the present invention, the latch 58 is released for each of the outriggers 70, 76 and the outriggers 70, 76 are retracted into the support unit 50 for storage and transportation.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A wallboard support system, comprising:

a support base;

a telescoping unit extending upwardly from said support base; and a cradle attached to an upper portion of said telescoping unit, wherein said cradle is capable of supporting a wallboard and wherein said cradle is comprised of a support unit having a first channel and a second channel, a first guide within said first channel of said support unit, a second guide within said second channel of said support unit, a first outrigger slidably extending within said first guide and said first channel, and a second outrigger slidably extending within said second guide and said second channel;

wherein said first guide and said second guide are angled upwardly;

wherein said first guide directs said first outrigger to extend outwardly and upwardly, and wherein said second guide directs said second outrigger to extend outwardly and upwardly;

wherein said first outrigger and said second outrigger are upwardly curved.

2. The wallboard support system of claim 1, wherein said telescoping unit is comprised of a lower portion attached to said support base and an upper portion that movably extends from said lower portion by a lifting/lowering mechanism.

3. The wallboard support system of claim 1, wherein said support unit is comprised of an elongated structure.

4. The wallboard support system of claim 1, wherein said first channel is substantially parallel with respect to said second channel.

5. The wallboard support system of claim 1, wherein said first guide directs said first outrigger to extend outwardly and upwardly, and wherein said second guide directs said second outrigger to extend outwardly and upwardly.

6. The wallboard support system of claim 5, wherein said first outrigger and said second outrigger substantially mirror one another when fully extended from said support unit.

7. The wallboard support system of claim 1, wherein said first outrigger and said second outrigger substantially mirror one another when refracted into said support unit.

8. The wallboard support system of claim 1, wherein said first outrigger and said second outrigger are upwardly curved.

9. The wallboard support system of claim 1, wherein said first guide and said second guide are angled upwardly.

10. The wallboard support system of claim 9, wherein said first guide and said second guide include a first lip and a second lip respectively extending upwardly from a respective upper inner portion that provides a desired angular alignment for said first guide and said second guide.

11. The wallboard support system of claim 1, wherein said support unit includes a divider extending along a substantially central portion of said support unit to form said first channel and said second channel.

12. The wallboard support system of claim 1, including a first latch attached to said support unit that selectively engages said first outrigger to secure said first outrigger in an extended position or refracted position.

13. The wallboard support system of claim 1, wherein said cradle includes a first cross member and a second cross member that extend substantially transverse with respect to said first outrigger and said second outrigger, wherein said first cross member and said second cross member are substantially parallel with respect to one another.

14. The wallboard support system of claim 1, wherein said first outrigger includes a first support extending upwardly from a distal portion thereof and wherein said second outrigger includes a second support extending upwardly from a distal portion thereof, wherein said first support and said second support are formed to engage a lower surface of a wallboard to be supported upon said cradle.

15. A wallboard support system, comprising:

a support base;

a telescoping unit extending upwardly from said support base; and a cradle attached to an upper portion of said telescoping unit, wherein said cradle is capable of supporting a wallboard and wherein said cradle is comprised of a support unit having a first channel and a second channel, a first guide within said first channel of said support unit, a second guide within said second channel of said support unit, a first outrigger slidably extending within said first guide and said first channel, and a second outrigger slidably extending within said second guide and said second channel;

wherein said first guide and said second guide are angled upwardly;

wherein said first guide directs said first outrigger to extend outwardly and upwardly, and wherein said second guide directs said second outrigger to extend outwardly and upwardly;

wherein said first outrigger and said second outrigger substantially mirror one another when fully extended from said support unit;

wherein said first outrigger and said second outrigger are upwardly curved.

16. The wallboard support system of claim 15, wherein said first outrigger and said second outrigger substantially mirror one another when retracted into said support unit.

17. The wallboard support system of claim 15, wherein said first guide and said second guide include a first lip and a second lip respectively extending upwardly from a respective upper inner portion that provides a desired angular alignment for said first guide and said second guide.

18. The wallboard support system of claim 15, wherein said support unit includes a divider extending along a substantially central portion of said support unit to form said first channel and said second channel.

19. The wallboard support system of claim 15, including a first latch attached to said support unit that selectively engages said first outrigger to secure said first outrigger in an extended position or retracted position.

20. A wallboard support system, comprising:

a support base having a plurality of wheels;

a telescoping unit extending upwardly from said support base, wherein said telescoping unit is comprised of a lower portion attached to said support base and an upper portion that movably extends from said lower portion by a lifting/lowering mechanism;

a cradle attached to an upper portion of said telescoping unit, wherein said cradle is capable of supporting a wallboard;

wherein said cradle is comprised of a support unit having a first channel and a second channel, a first guide within said first channel of said support unit, a second guide within said second channel of said support unit, a first outrigger slidably extending within said first guide and said first channel, and a second outrigger slidably extending within said second guide and said second channel;

wherein said support unit is comprised of an elongated structure;

wherein said first channel is substantially parallel with respect to said second channel;

wherein said first guide directs said first outrigger to extend outwardly and upwardly, and wherein said second guide directs said second outrigger to extend outwardly and upwardly;

wherein said first outrigger and said second outrigger substantially mirror one another when fully extended from said support unit;

wherein said first outrigger and said second outrigger substantially mirror one another when retracted into said support unit;

wherein said first outrigger and said second outrigger are upwardly curved;

wherein said first guide and said second guide are angled upwardly;

wherein said first guide and said second guide include a first lip and a second lip respectively extending upwardly from a respective upper inner portion that provides a desired angular alignment for said first guide and said second guide;

wherein said support unit includes a divider extending along a substantially central portion of said support unit to form said first channel and said second channel;

wherein said cradle includes a first cross member and a second cross member that extend substantially transverse with respect to said first outrigger and said second outrigger, wherein said first cross member and said second cross member are substantially parallel with respect to one another;

wherein said first outrigger includes a first support extending upwardly from a distal portion thereof and wherein said second outrigger includes a second support extending upwardly from a distal portion thereof, wherein said first support and said second support are formed to engage a lower surface of a wallboard to be supported upon said cradle; and a first latch attached to said support unit that selectively engages said first outrigger to secure said first outrigger in an extended position or retracted position.

* * * * *